US006723203B2

(12) United States Patent
Roussel et al.

(10) Patent No.: US 6,723,203 B2
(45) Date of Patent: Apr. 20, 2004

(54) ABSORBENT PAPER PRODUCT WITH ASYMMETRIC STRUCTURE

(75) Inventors: Gilles Roussel, Durrenentzen (FR); Michel Basler, Issenheim (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 10/031,205

(22) PCT Filed: May 11, 2001

(86) PCT No.: PCT/FR01/01433

§ 371 (c)(1),
(2), (4) Date: Jan. 10, 2002

(87) PCT Pub. No.: WO01/86066

PCT Pub. Date: Nov. 15, 2001

(65) Prior Publication Data

US 2002/0148579 A1 Oct. 17, 2002

(30) Foreign Application Priority Data

May 12, 2000 (FR) ..... 00/06108

(51) Int. Cl.[7] ..... D21H 21/40; D21H 21/38

(52) U.S. Cl. ..... 162/111; 162/117; 162/123; 162/125

(58) Field of Search ..... 162/111, 117, 162/123, 125; 428/195, 211, 537.5

(56) References Cited

U.S. PATENT DOCUMENTS

| | | | | | |
|---|---|---|---|---|---|
| 3,556,907 | A | * | 1/1971 | Nystrand | 156/209 |
| 3,738,905 | A | * | 6/1973 | Thomas | 156/205 |
| 3,868,205 | A | * | 2/1975 | Thomas | 156/555 |
| 5,173,351 | A | * | 12/1992 | Ruppel et al. | 162/111 |
| 5,374,468 | A | * | 12/1994 | Babinsky et al. | 162/109 |
| 5,736,223 | A | * | 4/1998 | Laurent | 156/209 |
| 5,906,711 | A | * | 5/1999 | Barnholtz | 162/132 |
| 6,287,676 | B1 | * | 9/2001 | Ruppel et al. | 428/191 |

FOREIGN PATENT DOCUMENTS

WO 99/45205 * 9/1999

* cited by examiner

*Primary Examiner*—José A. Fortuna
(74) *Attorney, Agent, or Firm*—Quarles & Brady LLP

(57) ABSTRACT

The invention concerns a cotton-wool-like cellulose having a basis weight of about 20 to about 80 g/m$^2$ comprising, an embossed ply of 10 to 40 g/m$^2$, including raised designs consisting at least partly of discrete protuberances oriented towards the inside of the structure, and a non-embossed ply. The invention is characterised in that the embossed ply has over at least a surface portion at least 30 protuberances per cm$^2$ whereof the surface is less than 1 mm$^2$, preferably less than 0.7 mm$^2$, and the basis weight of the embossed ply is less than that of the non-embossed ply. Preferably, it is less by 5 to 30%.

16 Claims, 1 Drawing Sheet

ABSORBENT PAPER PRODUCT WITH ASYMMETRIC STRUCTURE

Figure 1:
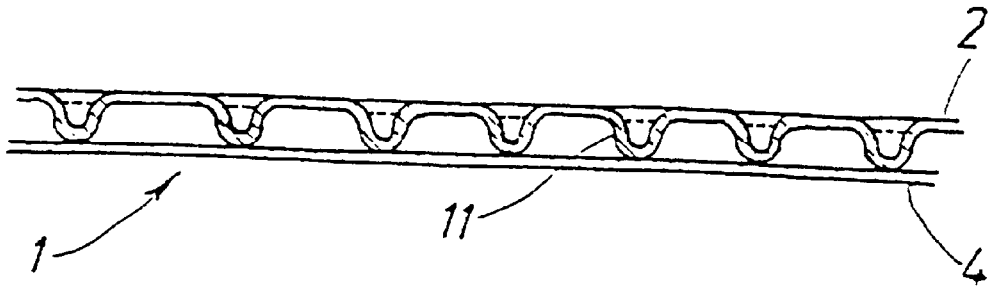

The present invention relates to products made of absorbent paper and more particularly made of cellulose wadding, for sanitary or household use and is aimed at a sheet consisting of at least two plies, one of which is embossed, intended for producing toilet paper essentially, but also tissues, serviettes or kitchen roll.

In the sanitary or household paper industry, use is made, for producing these products, of an absorbent paper, generally crêped, of low grammage known as cellulose wadding or tissue. The capacity of the structure to lengthen, which capacity is given, for example, by crêping, is put to good use to allow the sheet to be embossed, that is to say to deform it in places permanently and obtain protrusions on one face corresponding to hollows on the other face.

Specifically, the tendency over the last few years, as regards hygiene products, has been to make them softer and gentler by working with their thickness and strength characteristics, particularly using embossing. Embossing also makes it possible to improve the visual appearance of the product. The embossing operation is performed either on paper with a high moisture content, that is to say in the wet part of the paper-making machine, or on paper with a low moisture content, that is to say during converting. The present invention relates to paper converted in the dry part.

The most commonly used embossing patterns consist of a geometrical repeat of elemental protrusions of small area or transverse top, that is to say with a small area at the top, and with a simple geometric shape. An example is described in patent U.S. Pat. No. 3,414,459 which relates to a sheet with two or three plies, that is to say consisting of a number of elemental sheets, known as plies, connected or bonded together. The plies are embossed with a protrusion repeat and a protrusion height that suit the production of water-absorbing products such as kitchen roll, the number of protrusions ranging from 5 to 30 per $cm^2$. In addition, the Applicant Company has developed, for toilet paper in particular, patterns with a higher number of elements, ranging from 30 to 80 per $cm^2$. In this case, because of their number, the elements form protrusions of a shorter height and of necessity have an elemental area at the top which is also very small, less than 1 $mm^2$. In these last embodiments, an appearance is obtained which mimics that of a woven product. An example is described in patent EP 0 426 548. This type of embossing affects mainly the characteristics associated with the thickness of the sheet, on the one hand, and with its rigidity and strength, on the other hand. These patterns make it possible to reach a good compromise between the desired improvements in the characteristics when the semi-finished product is being converted into a finished product, and industrial operating conditions; in particular, they allow sufficient embossing intensity to be employed. However, they have a limited visual attraction.

Other products made of absorbent paper consist of two or more plies but are obtained according to a different association technique. On the one hand, a single or double ply is embossed and, on the other hand, a second ply, also single or double, is embossed, but using two separate embossing devices. The first ply and the second ply are embossed with patterns in relief which consist of protrusions. The pattern density of necessity remains low: less than 20 protrusions/$cm^2$ for this type of product. What happens is that the two plies are associated using a marrying roll so that the distal surfaces of the protrusions of the two superposed plies are arranged facing areas located between two protrusions in the plane of the second ply. This technique is also known as the "nested" process. With a structure of this type, the objective is to obtain thick products with a good handle. However, and especially for application to toilet paper, gentleness is not optimized because of the relatively coarse embossing. Furthermore, it is necessary for the embossing to be significant in order to obtain the desired great thickness.

In both double-sheet embodiments the two plies are embossed. While embossing gives each of the plies thickness, it does, however, lead to an appreciable reduction in its rupture strength. What happens is that the mechanical work done on the sheet is accompanied by a relaxation of the inter-fiber connections in the embossed regions.

The first objective of the invention is therefore to produce a double sheet, the rupture strength of which is improved by comparison with an embossed double sheet of the same thickness.

Conversely, by increasing the embossing pressure, the thickness of the sheet and/or the quality of the marking of the embossed pattern is increased, but this is limited by the need not to introduce an excessive drop in rupture strength.

The second objective of the invention is to produce a double sheet whose thickness and/or in which the visibility of the embossed pattern is improved by comparison with an embossed double sheet of the prior art while at the same time having good rupture strength.

According to the invention, a sheet satisfying one or other of the two objectives mentioned hereinabove, consisting of a ply made of crêped cellulose wadding of grammage 10 to 40 $g/m^2$ and embossed with patterns in relief consisting at least partly of discrete protrusions facing toward the inside of the sheet, and at least one unembossed ply, is characterized in that the embossed ply has, over at least a portion of its area, at least 30 protrusions per $cm^2$, the area at the top of which is less than 1 $mm^2$ and preferably less than 0.7 $mm^2$, the two plies having different grammages and/or different fiber compositions.

In particular, the grammages of the plies differ by more than 5%. As a preference, they differ by 5 to 30%.

The Applicant Company has found, surprisingly, that a double sheet thus characterized has the same thickness as a double sheet produced with two plies embossed in the same way as the embossed ply of the invention and assembled in the point-point position.

Furthermore, the Applicant Company has found, all other parameters being equal, that it is possible to a certain extent to reduce the grammage of the embossed ply while at the same time maintaining the resistance of the sheet to tearing. This is the strength measured in the transverse direction of the sheet. This combination thus allows an economy of material without sacrificing the robustness of the product or even its thickness. For example, it has been found that a sheet consisting of an embossed ply of 21 $g/m^2$ and an unembossed ply of 23 $g/m^2$ has the same strength in the transverse direction as a sheet consisting of the two 23 $g/m^2$ plies one of which had been embossed under the same conditions, that is to say with the same amount of imprint, as the previous 21 $g/m^2$ ply.

It is possible to produce other combinations within the context of the invention.

Thus, it is possible to keep the same overall grammage and the same thickness but go for a stronger sheet. To this end, according to one embodiment according to the invention, an unembossed ply is chosen whose resistance to tearing is the same as that of the embossed ply but whose grammage is slightly higher. The increase in weight is compensated for by using a lighter embossed ply which is embossed in such a way as to obtain the same thickness as the previous sheet. The loss in strength of the entity resulting from the embossing of the lighter ply is lower thanks to the use of a heavier unembossed ply, the overall grammage itself remaining unchanged.

According to another embodiment, the embossed ply has a higher resistance to tearing. It is, for example, a paper, the fiber composition of which contains more long fibers. Indeed, it has been found that losses in strength are lower if the stronger ply is the embossed one.

According to another embodiment, the embossed ply has a greater grammage than the unembossed ply. By comparison with a product in which both plies are identical and have the same total grammage the physical characteristics are equal. However, it is found that there is an improvement in the visibility of the embossed pattern and in the quality of the marking.

It will be understood that it is thus possible, by applying the same teachings, to obtain a thicker sheet by embossing the embossed sheet more heavily while at the same time slightly increasing the grammage of the unembossed ply.

The properties concerned with the thickness and the strength have been observed only for pattern densities at least equal to 30 bobbles per $cm^2$ on portions of area covering at least 30% of the total area.

The higher the number of protrusions locally, the lower the area at the top of these protrusions will be. It is preferably less than 0.7 $mm^2$ for 30 protrusions per $cm^2$ and preferably less than or equal to 0.4 $mm^2$ for 50 protrusions per $cm^2$.

In this technical field, "thickness" means the thickness measured on a stack of a certain number of sheets (for example 12 plies) to which slight pressure (2 kPa for example) is applied. It follows that the thickness takes into consideration a certain resistance that the structure has to crushing. Thus, without wishing to be tied to an explanation, maintaining the thickness of the structure of the invention results from the better resistance to crushing of a ply which has been embossed with a high pattern density.

According to another characteristic, the product according to the invention has at least 30 protrusions per $cm^2$ over at least 50% of the total area.

According to another characteristic, the number of protrusions is at least 50 per $cm^2$.

According to another characteristic, the product has a second embossed pattern between said portions of area. Advantageously, this pattern may be of linear type, that is to say may consist of protrusions whose area at the top is of linear shape and depicts, for example, the outline of a flower. More specifically, the first and the second pattern may be at different levels. In other words, their respective tops may be at different heights with respect to the plane of the ply.

Figure 2:
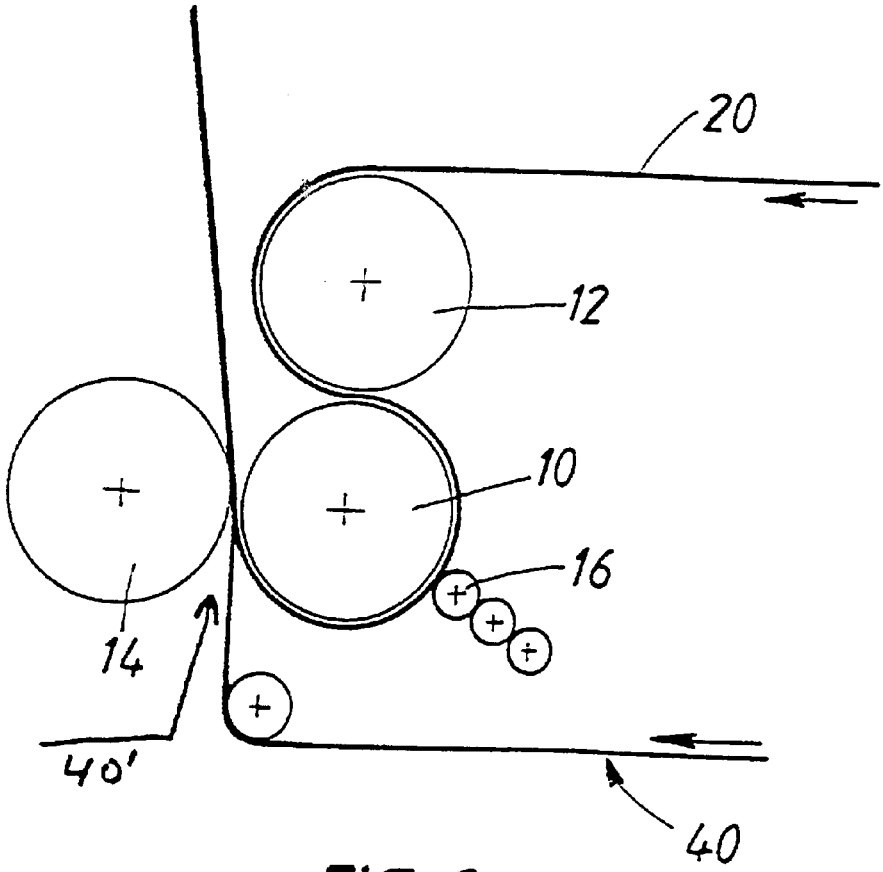

The invention is described in greater detail in the following presentation of one embodiment, with the appended drawings, in which:

FIG. 1 schematically depicts an enlarged cross section of the structure produced according to the invention;

FIG. 2 depicts an installation for performing the invention.

With reference to FIG. 1, the product 1 comprises two plies, an embossed ply 2 and an unembossed or plain ply 4. The embossed ply comprises protrusions 11 distributed at a determined spacing over at least one portion of its area. When considering the structure of the product, the protrusions of the embossed ply face toward the inside of the sheet. The two plies are preferably connected together. In particular, they may be connected at the distal areas of the protrusions of the embossed ply. Advantageously, the two plies are connected by bonding.

The product according to the invention has a grammage of about 20 to 80 $g/m^2$. Each of the plies is made of cellulose wadding. Cellulose wadding is an absorbent paper of low grammage of between 10 and 40 $g/m^2$. When manufactured according to the conventional wet pressed (CWP) technique, the sheet is pressed against a drying roll while still wet. The sheet is dried on the roll and is detached by means of a blade known as a crêping doctor. The wrinkles or crêping lines are formed at this stage in the manufacture.

Over portions of the area which together represent at least 30% of the total area, the embossed ply has a pattern density higher than 30 protrusions/$cm^2$ and less than 300, preferably a density less than 90 protrusions/$cm^2$. It may also additionally have one or more types of different pattern which themselves have different pattern densities. The protrusions may therefore have different heights, and the ply may have patterns at different levels. European patent applications 0 426 548 and 0 797 705 illustrate embossed products according to these principles but comprising two embossed plies.

In the product according to the invention, according to a first characteristic, the second ply is unembossed.

The fiber and/or chemical composition of the plies may be identical or different. In particular, according to one embodiment of the invention, the embossed ply has a fiber composition essentially based on long fibers such as resinous fibers, and the unembossed ply has a fiber composition essentially based on short fibers. This combination makes it possible to obtain a stronger product without sacrificing the softness afforded by the short fibers. According to another embodiment, one of the plies comprises a temporary or possibly permanent wet strength additive. If this additive is already present in a certain quantity in the embossed ply, the unembossed ply may contain a greater or conversely a lesser amount of it. An example of a wet strength additive is a compound of the polyamine epichlorhydrine type, marketed under the name KYMENE SLX by the HERCULES company. According to another embodiment, one of the plies, preferably the embossed ply, comprises a softener or a breakdown promoter. The sheet thus formed has very good wet strength and therefore very good robustness due, in particular, to the composition of the unembossed ply. It also offers surface softness because of the choice of the fiber and chemical composition of the embossed ply.

According to one embodiment of the invention, the embossed ply 2 is lighter than the unembossed ply. As a preference, the plies have a difference in grammage of at least 5%. The sheet has been depicted with the two plies 2 and 4 superposed. They are arranged in such a way that the protrusions are inside the sheet. The two plies may be connected to one another in any way known to those skilled in the art, such as, for example, mechanically by rolling, that is to say by passing the sheet between a knurling wheel and a plain backing roll.

However, as a preference, the two plies are connected together by means of an adhesive substance inserted between the tops of the protrusions of the plies depicted which come into contact. The adhesive substance is then preferably deposited on the highest tops of the elements of the pattern, and may advantageously be colored so as to emphasize details. Thus, when the embossed ply has protrusions, the tops of which are at different levels, a product which is partially associated over a small area is produced. The product obtained is particularly flexible when said area of association is less than 5%.

FIG. 2 depicts a machine for manufacturing such a sheet structure. It consists essentially of elements forming part of the prior art. A first embossing roll 10 has been engraved with a pattern with bobbles of a shape suited to the desired protrusions. The method consists in embossing a ply of cellulose wadding 20, paid out from a reel, not depicted, between the embossing roll 10 and a rubber roll 12 then in assembling, using a marrying roll 14, an unembossed cellulose wadding ply 40, also paid out from a reel, not depicted, with the first 20 while it is still in contact with the embossing roll. Beforehand, the adhesive substance, preferably a water based substance, would have been applied as necessary to the tops of the embossed ply, using a coating roll 16.

The products according to the invention have very advantageous characteristics by comparison with the two-ply products that already exist.

This is illustrated by the following examples in which sheets of cellulose wadding of toilet paper quality and of different grammages have been used to produce products according to the invention, that is to say ones with just one embossed ply and having different grammages, and products with just one embossed ply but which are made from sheets of the same grammage. In the first three examples, the fiber composition of the various plies was the same, that is to say: 50% of short fibers such as eucalyptus fibers and 50% of long fibers. In these three examples, the embossing pattern is the one currently marketed under the tradename LOTUS. It comprises a first pattern consisting of relatively broader elements, for example flowers, spaced apart, and a second pattern covering the area between the elements of the first pattern and consisting of 80 protrusions per $cm^2$. The area at the top of these protrusions is less than 0.4 $mm^2$.

In example A, a combined product produced using plies of tissue paper with different grammages (A1, A2) was compared with a combined product produced with plies of tissue paper with the same grammage (A2). The plies were respectively 21 $g/m^2$ for A1 and 23 $g/m^2$ for A2 before conversion. The papers were chosen so that their strengths measured in the transverse direction had roughly the same value (102–104 N/m). Checks were performed to determine whether the conversion of the ply of lower grammage affected the strength of the whole. It was found that for one and the same embossing imprint (28 mm), similar physical characteristics were obtained on the products: they have the same thickness (0.37–0.38 mm) and the value of their strength in the transverse direction dropped to the same extent (86–88 N/m). Thus, in a product according to the invention, there is an 8.5% reduction in the grammage for similar physical properties in the end product.

In example B, a combined product produced with plies of tissue paper of the same grammage (two plies B1 of 21 $g/m^2$ before conversion) was compared with a combined product produced with plies of tissue paper with different grammages (one ply B2 of 18 $g/m^2$ and one ply B3 of 23 $g/m^2$ before conversion) but the overall grammage of which was roughly the same. The paper qualities were chosen so that the strengths measured in the transverse direction had the same value (100–102 N/m). It was found that by embossing one of the plies in the first instance, and the ply of lowest grammage in the second instance, products were obtained that had the same thickness (0.37–0.38 mm) but markedly higher strength (94–77 N/m) in the case of the product with different grammages. Thus, with the overall grammage over two plies identical, the strength of the end product is significantly improved using a combination of different grammages.

In example C, use was made of a ply C1 of 21 $g/m^2$ and a ply C2 of 23 $g/m^2$. As opposed to example A, the effect of an increase in the embossing imprint of the embossed ply was examined. Thus, the embossing imprint of the embossed ply was increased while at the same time looking to maintain the same value of strength in the transverse direction of the end product. This was obtained by choosing a higher grammage for the unembossed ply. It was thus possible to increase the thickness by 20% (0.034–0.42 mm).

In example D, a first ply D1, 18 $g/m^2$, had a fiber composition based on long fibers, such as of resinous wood, and of short fibers, such as of eucalyptus wood. Its strength in the transverse direction ST and running direction SM are 81 N/m and 150 N/m respectively. In the case of the second ply D2, 18 $g/m^2$, its fiber composition was chosen so that it had poorer mechanical characteristics: for ST a value of 50 N/m and for SM a value of 97 N/m. It was found that by embossing D1, a D1/D2 structure was obtained that was stronger than if D2 were embossed, with the other characteristics being equal.

In example E, two structures consisting of two plies with different grammages and one structure with the same overall grammage but in which the two plies were identical, were produced.

The grammages were, respectively, for E1, 21 $g/m^2$, for E2, 23 $g/m^2$ and for E3, 18 $g/m^2$. It was found that it was possible to obtain a product with the same transverse strength as the product consisting of two plies with the same grammage with the same total weight but in which the visibility was greater with a heavier ply.

These results are collated in the table below.

| | Plys of tissue paper and structures | $g/m^2$ | Thickness mm | Strength SM N/m | Strength ST N/m | Embossing imprint mm |
|---|---|---|---|---|---|---|
| | A1 | 21 | | 120 | 50 | |
| | A2 | 23 | | 148 | 52 | |
| A | A1 + A2 both plain | 43.4 | 0.27 | 268 | 102 | 0 |
| | Al embossed + A2 plain | 42.6 | 0.37 | 223 | 86 | 28 |
| | A2 + A2 both plain | 46 | 0.29 | 296 | 104 | |
| | A2 embossed + A2 plain | 45.2 | 0.38 | 255 | 88 | 28 |
| B | B1 | 21 | | 115 | 50 | |
| | B2 | 18 | | | | |
| | B3 | 23 | | | | |
| | B1 + B1 both plain | 40.8 | 0.24 | 230 | 100 | 0 |
| | B1 plain + B1 embossed | 41.1 | 0.35 | 214 | 77 | 28 |
| | B2 + B3 both plain | 40.9 | 0.25 | 245 | 102 | 0 |
| | B2 embossed + B3 plain | 41.1 | 0.34 | 226 | 94 | 28 |
| C | C1 | 21 | | 115 | 50 | |
| | C2 | 23 | | 153 | 52 | |
| | C1 + C1 both plain | 40.8 | 0.24 | 230 | 100 | 0 |
| | C1 embossed + C1 plain | 41.1 | 0.34 | 214 | 77 | 28 |
| | C1 + C2 both plain | 43.4 | 0.27 | 268 | 102 | 0 |
| | C1 embossed + C2 plain | 42.4 | 0.42 | 205 | 74 | 34 |
| D | D1 | 18 | | 150 | 81 | |
| | D2 | 18 | | 97 | 50 | |
| | D1 + D2 both plain | 35.6 | 0.2 | 247 | 131 | |
| | D1 plain + D2 embossed | 35.7 | 0.31 | 216 | 100 | |
| | D1 embossed + D2 plain | 35.5 | 0.31 | 239 | 107 | |
| E | E1 | 21 | | 115 | 50 | |
| | E2 | 23 | | | | |
| | E3 | 18 | | | | |

-continued

| Plys of tissue paper and structures | g/m² | Thickness mm | Strength SM N/m | Strength ST N/m | Embossing imprint mm |
|---|---|---|---|---|---|
| E1 + E1 both plain | 40.8 | 0.24 | 230 | 100 | |
| E1 embossed + E1 plain | 41.1 | 0.35 | 214 | 77 | 28 |
| E2 + E3 both plain | 40.9 | 0.25 | 245 | 102 | |
| E2 embossed + E3 plain | 40.3 | 0.33 | 232 | 76 | 28 |
| E2 plain + E3 embossed | 41.1 | 0.34 | 226 | 94 | 28 |

What is claimed is:

1. A product made of cellulose wadding with a grammage of about 20 to 80 g/m² comprising only one embossed ply made of creped cellulose wadding having a grammage of 10 to 40 g/m², said embossed ply having patterns of relief including discrete protrusions facing toward the inside of the structure, and said product having at least one unembossed ply, characterized in that the embossed ply has, over at least a portion of its area, at least 30 protrusions per cm², the area of the top of each protrusion being less than 1 mm², the embossed ply and the unembossed ply having at least one of different grammages and different fiber compositions.

2. The product as claimed in claim 1, wherein the grammages of the two plies differ by at least 5%.

3. The product as claimed in claim 2, wherein the grammages differ by 5 to 30%.

4. The product as claimed in claim 1, wherein a grammage of the embossed ply is between 15 and 20 g/m² and a grammage of the unembossed ply is between 21 and 25 g/m².

5. The product as claimed in claim 1, wherein a grammage of the embossed ply is between 21 and 25 g/m² and a grammage of the unembossed ply is between 15 and 20 g/m².

6. The product as claimed in claim 1, wherein the fiber compositions differ so that one of the plies has greater resistance to tearing than the other.

7. The product as claimed in claim 6, wherein the embossed ply is stronger than the unembossed ply.

8. The product as claimed in claim 1, wherein the embossed ply has, over at least 30% and of the total area, at least 30 protrusions per cm².

9. The product as claimed in claim 1, wherein the number of protrusions is at least 50 per cm², and their area at the top is less than or equal to 0.4 mm².

10. The product as claimed in claim 1, the product having a second pattern of embossed protrusions between said portions of area.

11. The product as claimed in claim 10, wherein the connection is obtained by bonding the protrusions of the second pattern, at least in part.

12. The product as claimed in claim 10, wherein said product comprises a second unembossed ply.

13. The product as claimed in claim 1, wherein the plies are joined to one another.

14. The product as claimed in claim 1, wherein the plies are associated by connecting the distal surfaces of at least some of the protrusions of the embossed ply to said unembossed ply.

15. The product as claimed in claim 1, wherein the area at the top of said protrusions of the unembossed ply is less than 0.7 mm.

16. The product as claimed in claim 1, wherein the unembossed ply is made of a creped material.

* * * * *